US010156422B1

(12) United States Patent
Valin

(10) Patent No.: US 10,156,422 B1
(45) Date of Patent: Dec. 18, 2018

(54) FIREARM STOCK ASSEMBLY, RECOIL REDUCTION DEVICE AND RELATED METHODS

(71) Applicant: Norman A. Valin, Spring Hill, FL (US)

(72) Inventor: Norman A. Valin, Spring Hill, FL (US)

( * ) Notice: Subject to any disclaimer, the term of this patent is extended or adjusted under 35 U.S.C. 154(b) by 486 days.

(21) Appl. No.: 14/642,815

(22) Filed: Mar. 10, 2015

(51) Int. Cl.
*F41C 23/00* (2006.01)
*F41C 23/06* (2006.01)
*F41C 23/20* (2006.01)

(52) U.S. Cl.
CPC ..... *F41C 23/06* (2013.01); *F41C 23/20* (2013.01)

(58) Field of Classification Search
CPC ..... F41C 23/06; F41C 23/08; F41C 23/14; F41C 23/20; F16F 15/067
USPC ..... 42/74, 73, 71.01, 1.06, 75.03
See application file for complete search history.

(56) References Cited

U.S. PATENT DOCUMENTS 247,451 A 9/1881 White
490,129 A 1/1893 Tredway et al.
524,458 A 8/1894 Blake
837,601 A 12/1906 Behr
935,163 A 9/1909 Parker
1,255,566 A 2/1918 Pearson
1,307,529 A 6/1919 Werndl
1,328,700 A 1/1920 Wagoner
1,334,467 A 3/1920 Moller
1,896,454 A * 2/1933 Marek ..... F41A 25/06 89/42.01
2,754,608 A * 7/1956 Stieffel, Jr. ..... F41C 23/06 42/74
3,039,222 A * 6/1962 Hoge ..... F41C 23/06 42/74
3,176,424 A * 4/1965 Hoge ..... F41C 23/06 42/74
3,209,482 A * 10/1965 Kuzma ..... F41C 23/06 267/128
3,233,354 A * 2/1966 Ahearn ..... F41C 23/06 42/74
3,418,880 A * 12/1968 Herlach ..... F41A 25/18 188/317
3,707,797 A 1/1973 Ruth
3,714,726 A * 2/1973 Braun ..... F41C 23/06 42/74
3,795,998 A * 3/1974 Kuhl ..... C06F 1/08 42/74
4,439,943 A 4/1984 Brakhage
4,663,877 A 5/1987 Bragg
4,910,904 A * 3/1990 Rose ..... F41C 23/06 42/73
5,031,348 A * 7/1991 Carey ..... F41C 23/06 42/71.01

(Continued)

*Primary Examiner* — Michael David
(74) *Attorney, Agent, or Firm* — Allen Dyer Doppelt & Gilchrist

(57) ABSTRACT

A firearm stock assembly includes a firearm stock and a recoil reduction device. The recoil reduction device includes a butt plate and a first collapsible element connected between a butt end of the firearm stock and the butt plate. The first collapsible element is configured to maintain a fixed distance between the butt end and the butt plate until a compressive force between the firearm stock and the butt plate reaches a recoil threshold.

14 Claims, 5 Drawing Sheets

(56) References Cited

U.S. PATENT DOCUMENTS

| | | | | |
|---|---|---|---|---|
| 5,392,553 | A * | 2/1995 | Carey | F41C 23/14 42/73 |
| 5,410,833 | A * | 5/1995 | Paterson | F41C 23/06 42/73 |
| 5,974,718 | A | 11/1999 | Bentley et al. | |
| 6,481,143 | B2 | 11/2002 | McCarthy | |
| 6,758,126 | B1 * | 7/2004 | Houtsma | F41A 3/94 42/1.06 |
| 7,121,032 | B2 * | 10/2006 | Daul | F41C 23/08 42/1.06 |
| 7,493,717 | B2 | 2/2009 | Beretta | |
| 7,698,987 | B2 * | 4/2010 | Jebsen | F41A 3/56 89/191.01 |
| 7,992,337 | B2 | 8/2011 | Ochoa | |
| 8,413,361 | B2 * | 4/2013 | Quaedpeerds | F41C 23/06 42/1.06 |
| 8,434,252 | B2 * | 5/2013 | Holmberg | F41A 3/84 42/1.06 |
| 9,021,729 | B2 * | 5/2015 | Moretti | F41C 23/06 42/1.06 |
| 9,038,524 | B2 * | 5/2015 | Jebsen | F41A 3/56 42/28 |
| 2008/0178508 | A1 | 7/2008 | Cinciu | |
| 2013/0145668 | A1 * | 6/2013 | Valin | F41C 23/08 42/74 |

* cited by examiner

FIREARM STOCK ASSEMBLY, RECOIL REDUCTION DEVICE AND RELATED METHODS

FIELD OF THE INVENTION

The present invention relates to firearms, and more particularly, to recoil reduction mechanisms for firearms.

BACKGROUND OF THE INVENTION

Various recoil absorption/reduction mechanisms have been proposed for shotguns and other firearms subject to vigorous recoil forces. In such mechanisms, a spring or other compressible element is interposed between a firearm butt plate and the butt end of the stock. An example of such a recoil reduction mechanism can be seen in the present inventor's U.S. Pat. No. 8,516,730, the contents of which are herein incorporated by reference in their entirety. While such mechanisms can help reduce the recoil forces transmitted to the shoulder of the firearm user, further improvements are possible.

SUMMARY OF THE INVENTION

According to an embodiment of the present invention, a firearm stock assembly includes a firearm stock and a recoil reduction device. The recoil reduction device includes a butt plate and one or more collapsible elements connected between a butt end of the firearm stock and the butt plate. The collapsible elements are configured to maintain a fixed distance between the butt end and the butt plate until a compressive force between the firearm stock and the butt plate reaches a recoil threshold.

According to an aspect of the present invention, a collapsible element includes a cylinder, a piston slidably arranged within the cylinder, and a releasable engagement mechanism arranged between the cylinder and the piston. In an extended position, the releasable engagement mechanism maintains a fixed relationship between the cylinder and the piston and releases when the compressive force reaches the recoil threshold allowing the piston to slide further into the cylinder. The collapsible element can further include a reset mechanism arranged between the cylinder and the piston, the reset mechanism returning the collapsible element to the extended position when the compressive force falls below the recoil threshold.

According to another aspect of the present invention, the releasable engagement mechanism includes at least one blocking element seated in the cylinder around the piston and a biasing mechanism urging the blocking element toward the piston. According to a further aspect, the at least one blocking element includes a plurality of ball bearings seated in channels extending through a circumferential wall of the cylinder and the biasing mechanism includes a o-ring seated in a circumferential groove in the circumferential wall outside the channels.

According to a method aspect, a method of altering a firearm stock includes forming a forwardly extending recess in a butt end of a firearm stock, and inserting a forward end of a recoil reduction device into the recess such that a rearward end thereof extends out of the recess with a butt plate held thereby at a fixed distance from the butt end until a compressive force between the firearm stock and the butt plate reaches a recoil threshold.

These and other objects, aspects and advantages of the present invention will be better understood in view of the drawings and following detailed description of preferred embodiments.

DETAILED DESCRIPTION OF PREFERRED EMBODIMENTS

Figure 1:
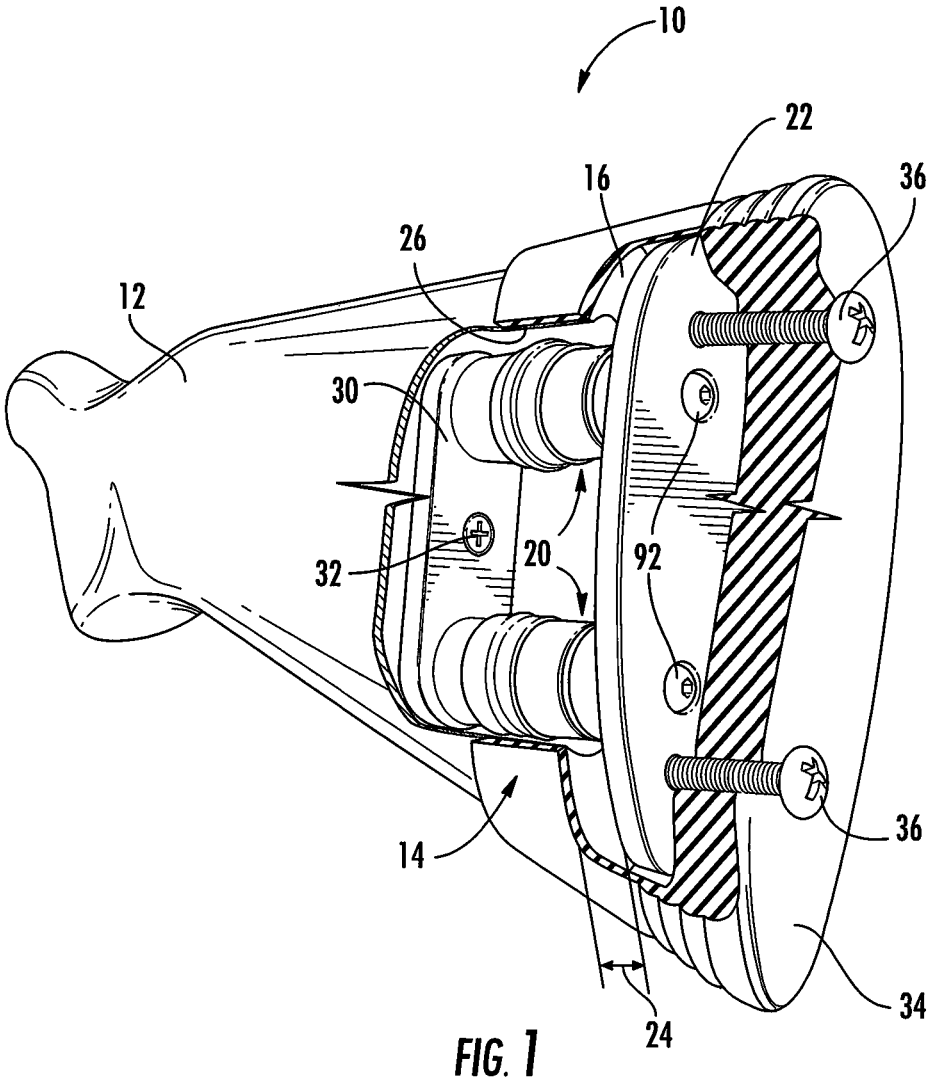
FIG. 1 is a perspective view of a firearm stock assembly including a firearm stock and a recoil reduction device, according to an embodiment of the present invention, partially cut-away to show internal details.
Figure 2:
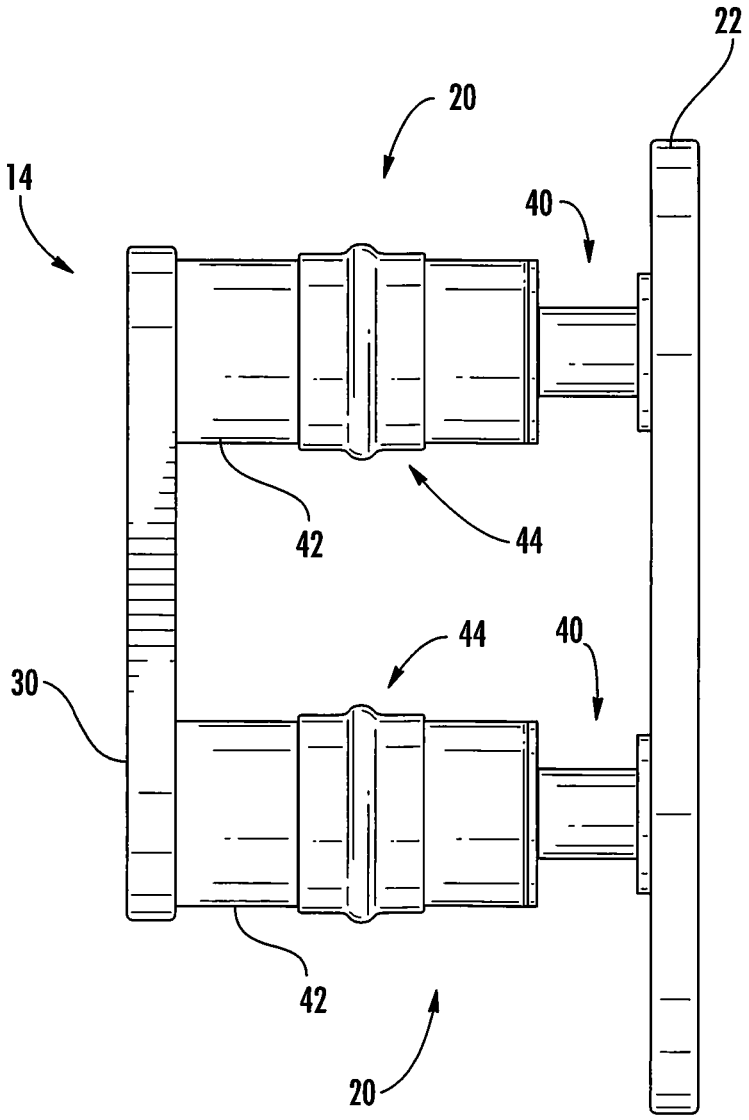
FIG. 2 is a side view of the recoil reduction device of FIG. 1, including a pair of collapsible elements.

Referring to FIGS. 1 and 2, a firearm stock assembly 10 includes a firearm stock 12 having a recoil reduction device 14 attached to a butt end 16 thereof. The recoil reduction device 14 includes one or more collapsible elements 20 holding a butt plate 22 a fixed distance 24 from the butt end 16. The collapsible elements 20 are configured to maintain the fixed distance 24 until a compressive force between the firearm stock 12 and the butt plate 22 reaches a recoil threshold. The recoil threshold is advantageously set such that the compressive form associate with shouldering and aiming an associated firearm would be below the recoil threshold, but the compressive force associated with firing the firearm would exceed the recoil threshold.

Advantageously, a portion of the recoil reduction device 14 extends into a recess 26 formed in the butt end 16 of the firearm stock 12. More particularly, the recoil reduction device 14 includes a mounting plate 30 to which the collapsible elements 20 are commonly attached opposite the butt plate 22. The mounting plate 30 is secured within the recess 26 by a screw 32 extending therethrough, or the like. A cushioned pad 34 is arranged over the recoil reduction device 14 and the butt end 16, and is secured to the butt plate 22 via screws 36 or the like.

Figure 3:
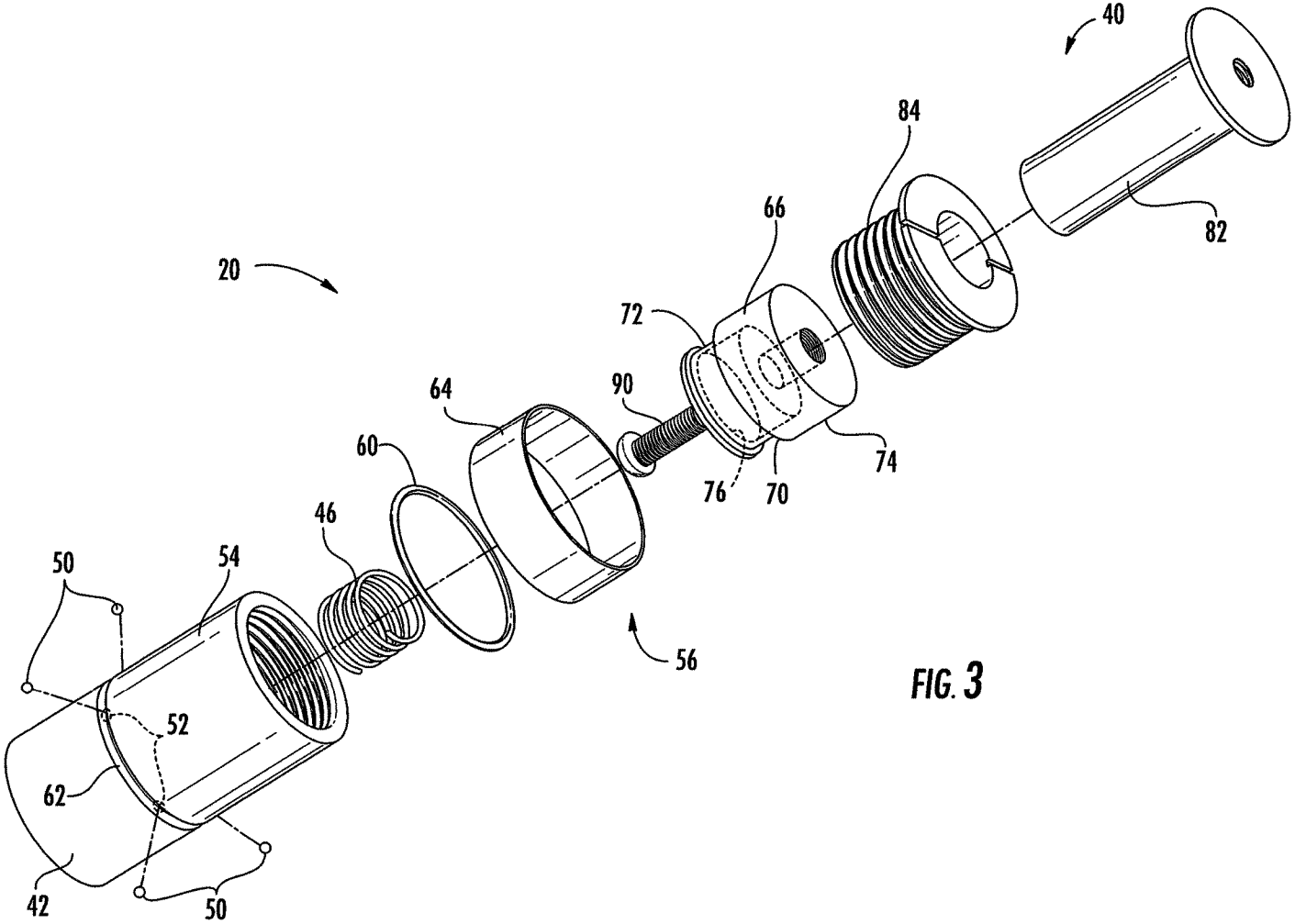
FIG. 3 is an exploded perspective view of an illustrative one of the collapsible elements of FIG. 2.
Figure 4:
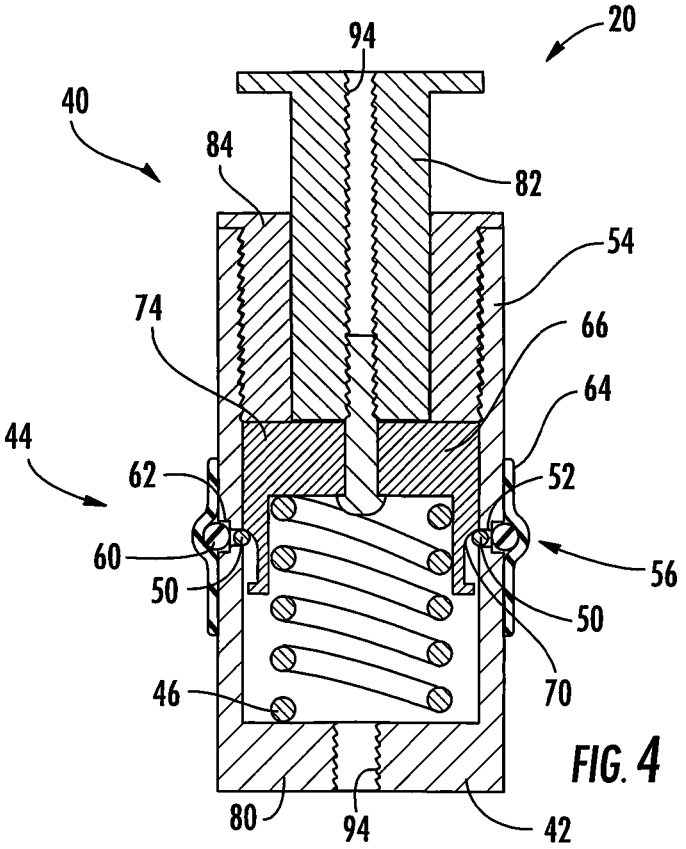
FIG. 4 is a sectional side view of the collapsible element of FIG. 3, in an extended position.
Figure 5:
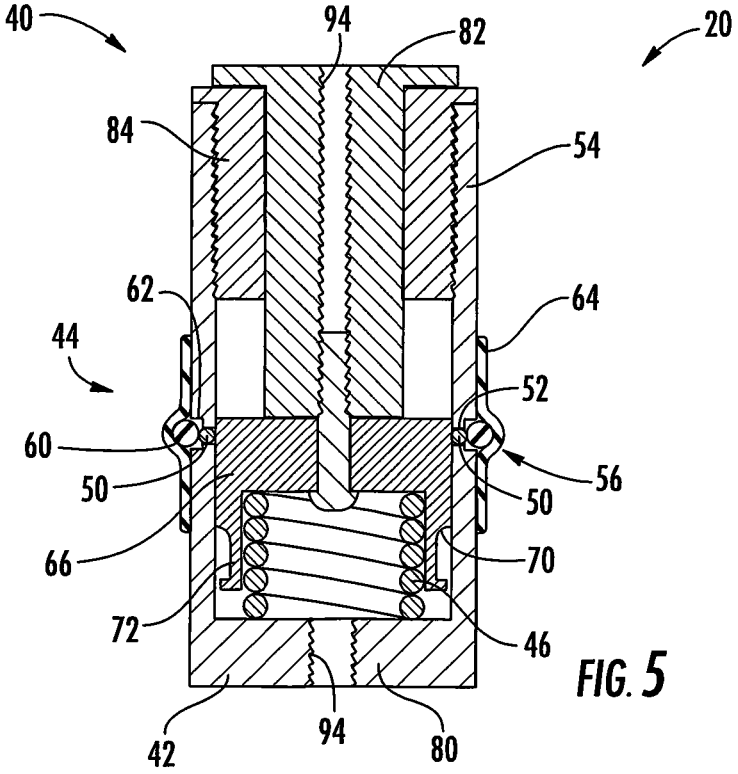
FIG. 5 is a sectional side view of the collapsible element of FIG. 3, collapsed from the extended position.

The collapsible elements 20 of the recoil reduction device 14 are preferably substantially identical. Referring to FIGS. 3-5, an exemplary one of the collapsible elements 20 is described in greater detail. The collapsible element 20 includes a piston 40 slidably arranged with a cylinder 42. A releasable engagement mechanism 44 is arranged between the piston and 40 and the cylinder 42. In an extended position (FIG. 4), the releasable engagement mechanism 44 maintains a fixed relationship between the cylinder 42 and the piston 40. When the compressive force reaches the recoil threshold, the releasable engagement mechanism 44 releases, allowing the piston 40 to slide further into the cylinder 42 (FIG. 5).

A reset mechanism 46, such as a reset coil spring, is also arranged between the cylinder 42 and the piston 40. When the compressive force falls below the recoil threshold, the reset mechanism 46 is able to automatically return the collapsible element 20 to the extended position. The releasable engagement mechanism 44 will automatically re-engage and the firearm stock assembly 10 is again for the next discharge of the firearm.

The releasable engagement mechanism 44 includes one or more blocking elements 50, such as ball bearings, seated in channels 52 formed in a circumferential wall 54 of the cylinder 42, as well as a biasing mechanism 56 that urges the blocking elements 50 into the travel path of the piston 40. The biasing mechanism 56 includes an elastic o-ring 60 seated in a circumferential groove 62 in the surface of the cylinder 42, onto which groove 62 outer ends of the passages 52 open. The biasing mechanism 56 further includes a flexible sleeve 64 covering the o-ring 60 and groove 62.

The piston 40 includes a piston head 66 having a peripheral lip 70. In the extended position, the biasing mechanism 56 urges the blocking elements 50 inwardly of the circumferential wall 54 into engagement with the peripheral lip 70, which prevents inward movement of the piston 40 further into the cylinder 42. As the compressive force between the firearm stock 12 and the butt plate 22 increases, the inward force exerted by the biasing mechanism 56 will be overcome by the inward force acting on the piston 40 and the blocking elements 50 will be forced outwardly into their respective channels 52, allowing the piston 40 to move further into the cylinder 42.

At this recoil threshold, the increased compressive force is also more than sufficient to overcome the opposite force exerted by the reset mechanism. When the increased compressive force is removed, the reset mechanism 46 is able to urge the piston 40 outwardly until the peripheral lip 70 clears the channels 52 and the biasing mechanism 56 of the releasable engagement mechanism 44 urges the blocking elements 50 back into the path of the peripheral lip 70.

Advantageously, the piston head 66 includes a first head portion 72 axially inward of the peripheral lip 70 and a second head portion 74 axially outward of the peripheral lip 70. The first head portion 72 has a smaller outer diameter than the second head portion 74, the lip 70 forming the radial transition between the first and second head portions 72, 74. The lip 70 can traverse a curve to make this transition smoother. The radial clearance between the first head portion 72 and circumferential wall 54 is less than the diameter of the blocking elements 50, such that the blocking elements 50 do not have to be otherwise restrained in the channels 52 to prevent falling down into the cylinder.

The piston head 66 can also define an inner axial end opening 76, in which one end of the reset mechanism 46 is seated. The opposite end of the reset mechanism 46 engages an axial end wall 80 of the cylinder 42.

To facilitate assembly of the collapsible element 20, the piston head 66 can be formed separately from a piston rod 82. A piston collar 84 threads into an open axial end of the cylinder 42 opposite the axial end wall 80. The piston rod 82 is inserted through the piston collar 84 and then connected to the piston head 66 by a screw 90, or the like. The reset mechanism 46 is placed into the cylinder 42, and the piston head 66 is inserted to seat over the reset mechanism 46 and the collar 84 is threaded into place. The blocking elements 50 are inserted into the channels 52 from outside the cylinder 42 and secured in place by seating the o-ring 60 into the groove 62. The sleeve 64 is shrink-fit or otherwise securely placed around the outside of the circumferential wall 54 around the o-ring 60 and groove 62. To complete the recoil reduction device 14, the collapsible elements 20 are secured between the mounting plate 30 and butt plate 22 by screws 92 (see FIG. 1), or the like, threaded into threaded bores 94 opposite ends of the piston 40 and the cylinder 42.

Figure 6:
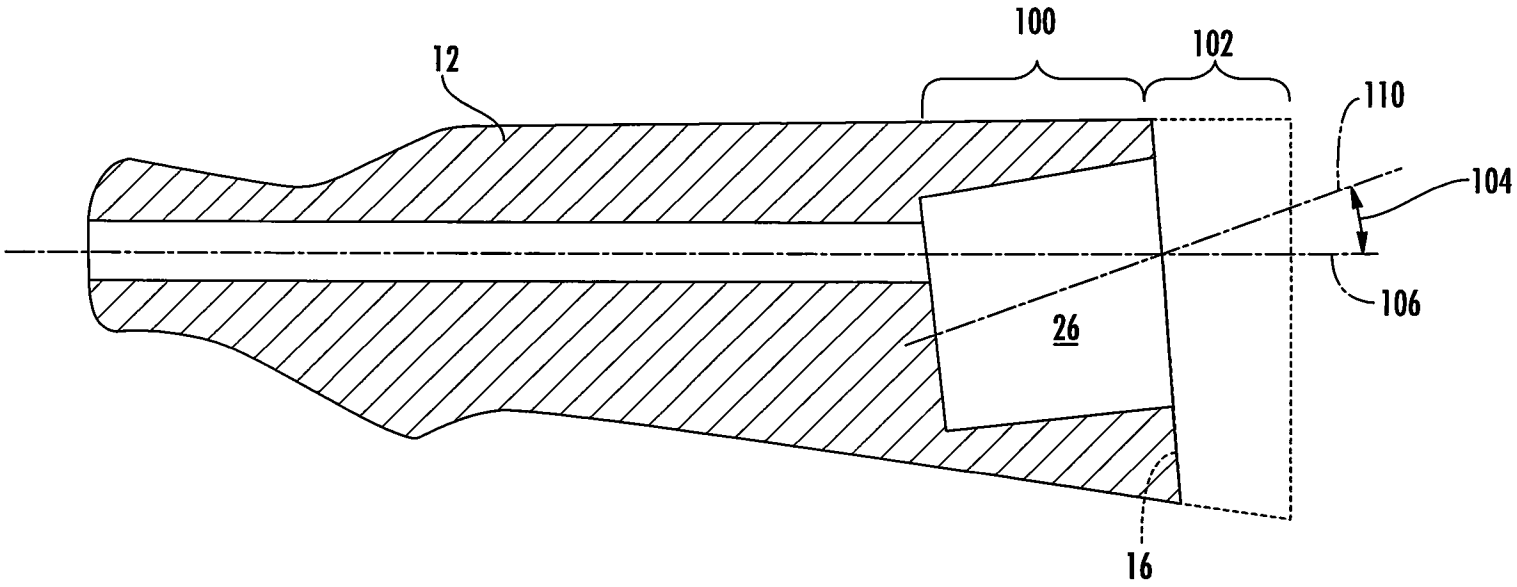
FIG. 6 is a sectional side view of the firearm stock of FIG. 1.

Referring to FIGS. 1 and 6, mounting of the recoil reduction device 14 to the firearm stock 12 affords opportunities to further alter and customize the firearm stock 12 to suit a particular user. The depth 100 of the recess 26 into the stock 12 from the butt end 16 should be shallow enough to allow the fixed distance 24 between all portions of the butt plate 22 and the butt end 16 to encompass the travel range of the collapsible element 20. Within that constraint, however, the effective length of the stock 12—the length including the recoil reduction device 14—can be changed by selecting the depth of the recess 26. To give an extreme example, the recess 26 could be omitted altogether, thus increasing the effective length of the stock 12 by the whole length of the recoil reduction device 14.

Changing the effective length of the stock 12 can also be effected based on the selection of a cutoff length 102, which refers to the length cut off the end of the stock 12. For example, to install a recoil reduction device 14 while maintaining the same effective length of the stock 12 as before alteration, a cutoff length equal to at least the minimum fixed distance 24 plus the thickness of the butt plate 22, with the recess 26 depth being set to accept the remainder of the recoil reduction device 14 therein. Additionally, an angle 104 of the butt plate relative to the firing axis 106 can be altered by offsetting a recess axis 110 from the firing axis.

From the foregoing, it will be appreciated that firearm stock assembly, including a recoil reduction device according to the present invention, allows a firearm user to have the benefits of the feel of a solid firearm stock when shouldering and aiming the firearm, while still enjoying the reduction in perceptible recoil associated with spring-loaded or otherwise equipped recoil absorption systems.

In general, the foregoing description is provided for exemplary and illustrative purposes; the present invention is not necessarily limited thereto. Rather, those skilled in the art will appreciate that additional modifications, as well as adaptations for particular circumstances, will fall within the scope of the invention as herein shown and described and the claims appended hereto.

What is claimed is:

1. A firearm stock assembly comprising;

a firearm stock having a butt end; and a recoil reduction device including a butt plate and a first collapsible element connected between the butt end and the butt plate, the first collapsible element including:

a cylinder;

a piston slidably arranged within the cylinder; and a releasable engagement mechanism arranged between the cylinder and the piston, the releasable engagement mechanism having at least one blocking element seated in the cylinder proximate the piston and an elastic biasing mechanism urging the at least one blocking element into a travel path of the piston with an inward force;

wherein the first collapsible element is configured to maintain a fixed distance between the butt end and the butt plate until a compressive force between the firearm stock and the butt plate reaches a recoil threshold at which the at least one blocking element is forced out of the travel path of the piston against the inward force of the elastic biasing mechanism.

2. The firearm stock assembly of claim 1, wherein the recoil reduction device includes a second collapsible element connected between the butt end and the butt plate, the second collapsible element being substantially identical to the first collapsible element.

3. The firearm stock assembly of claim 2, wherein the recoil reduction device further includes a mounting plate connected to the firearm stock, the first and second collapsible elements being connected in parallel between the mounting plate and the butt plate.

4. The firearm stock assembly of claim 1, wherein the at least one collapsible element further includes a reset mechanism arranged between the cylinder and the piston, the reset mechanism returning the collapsible element to the extended position when the compressive force falls below the recoil threshold.

5. The firearm stock assembly of claim 4, wherein the reset mechanism includes a spring.

6. The firearm stock assembly of claim 1, wherein the at least one blocking element includes a plurality of ball bearings.

7. The firearm stock assembly of claim 6, wherein the biasing mechanism includes an o-ring arranged around the cylinder and engaging the ball bearings.

8. The firearm stock assembly of claim 7, wherein the biasing mechanism further includes a flexible sleeve surrounding the cylinder outward of the o-ring.

9. The firearm stock assembly of claim 1, further comprising a recoil pad that covers the firearm stock and the recoil reduction device.

10. The firearm stock assembly of claim 1, wherein a mounting recess is defined in the butt end of the firearm stock and the first collapsible element extends thereinto.

11. A method of altering the firearm stock of claim 1 to include the recoil reduction device, the method comprising:

forming a forwardly extending recess in the butt end of the firearm stock;

inserting a forward end of the recoil reduction device into the recess such that a rearward end thereof extends out of the recess with the butt plate held thereby at a fixed distance from the butt end until the compressive force between the firearm stock and the butt plate reaches the recoil threshold.

12. The method of claim 11, wherein the butt plate is connected to the rearward end of the recoil reduction device after the forward end is connected to the butt end within the recess.

13. The method of claim 11, wherein forming the recess includes offsetting a recess axis from a firing access to alter a butt plate angle.

14. The method of claim 11, wherein forming the recess includes selecting at least one of a depth of the recess and a cutoff length of the firearm stock to alter an effective length of the firearm stock.

* * * * *